United States Patent [19]

De Lucia

[11] 4,168,480

[45] Sep. 18, 1979

[54] RELAY ASSEMBLY

[75] Inventor: Victor E. De Lucia, Santa Monica, Calif.

[73] Assignee: Torr Laboratories, Inc., Van Nuys, Calif.

[21] Appl. No.: 877,284

[22] Filed: Feb. 13, 1978

[51] Int. Cl.[2] ..... H01H 45/06; H01H 45/14

[52] U.S. Cl. ..... 335/151; 174/17 GF; 200/144 C; 335/201; 335/202

[58] Field of Search ..... 335/151, 152, 153, 154, 335/201, 202; 200/144 C, 144 B; 339/100, 272; 174/110 N, 17 GF; 528/347

[56] References Cited

U.S. PATENT DOCUMENTS

| | | | |
|---|---|---|---|
| 3,604,870 | 9/1971 | De Lucia | 335/153 |
| 4,039,984 | 8/1977 | De Lucia | 335/151 |

*Primary Examiner*—Harold Broome
*Attorney, Agent, or Firm*—Subkow and Kriegel

[57] ABSTRACT

A high voltage magnetic relay is enclosed by an insulating housing containing a gas such as sulfur hexafluoride under pressure. The switch terminals removably extend through a wall of the housing and are sealed. The magnet structure is removably connected to the housing by a sealed joint. A fill valve removably extends through a wall of the housing and is sealed thereto. The armature shifts a pivotal arm in the housing between open and closed contact positions.

The housing is formed of a polyamide material having the property of being resistant to deterioriation by fluorine gas, said material being poly hexamethylene terephthalic amide.

19 Claims, 8 Drawing Figures

RELAY ASSEMBLY

Electrical relays have been heretofore provided wherein a double pole, double throw switch is utilized to selectively control the application of a high voltage to the heart of a patient under precisely controlled conditions. Vacuum relays have the problem of ionization effects and have limited application. Relays have evolved which utilize a pressurized dielectric gas, such as sulfur hexafluoride ($SF_6$) to reduce ionization and to provide a cooling effect.

U.S. Pat. No. 3,604,870, granted to me Sept. 14, 1971, discloses a high voltage relay of the type referred to above, useful in a DC heart defibrillator operating at say, 7500 volts, wherein pressurized dielectric gas is contained in a glass housing for the relay. Such relays are very effective, but are subject to breakage and assembly difficulties. To avoid hazard from a broken housing, moreover, a protective cover is provided about the glass structure. In addition, the fluorine gas derived from the sulfur hexafluoride attacks the glass and, over a period of time, renders it opaque, which is objectionable. Arcing between terminals both internally and externally could also occur after a period of use, causing a malfunction.

The later U.S. Pat. No. 4,039,984, granted Aug. 2, 1977, to me and Nosser, discloses an improved pressurized relay assembly, operable at high voltage, say 100 to 30,000 volts, but which is very well suited for use in a high voltage heart defibrillator. According to this patent, the housing is of electrical insulating, synthetic resin material, such as polyamide or polycarbonate resins. Sulfur hexafluoride was used as a dielectric gas and the terminals and closure where bonded to the housing to seal the interior. Gas is supplied through a passage in the core of the electro-magnet, via a tube which is pinched closed after filling of the housing with the gas. Such structures are ideally suited for use as high pressure relays, but the bonded terminals and closure inhibit repair or service on an economical basis. Furthermore, the resin material was acted upon by the fluorine derived from the sulfur hexafluoride, in the relay, unless the housing was coated to prevent contact of the fluorine with the polyamide material of the housing. To avoid this problem, as a practical matter, the housings were coated with a clear epoxy material which was resistant to the fluorine gas to preserve the transparency of the polyamide. Such polyamides being of a crystalline nature tend towards crystallization and become more cloudy with age, so that, in any event lacked permanent transparency.

The present invention relates to an improved, high voltage relay of the type useful in DC heart defibrillators which is easy to assemble, evacuate, fill with dielectric gas, to a number of atmospheres, and disassemble for service and repair.

The present invention also relates to an improved, high voltage relay of the type useful in DC heart defibrillators, which has a transparent housing made from a resin or polyamide material which has superior insulating qualities, is easy to mold, has high impact resistance, is easy to machine, and retains its transparency in the presence of the products of the dielectric gas caused by arcing in the relay.

Further, the invention provides a high voltage relay wherein the housing is constructed in a form which reduces the likelihood of arcing between terminals.

While many polyamide resins are commercially available for use in producing housings for high voltage relays of the type here involved, they vary in terms of their electrical insulating properties, impact resistance, dimensional stability under heat, water absorption, and the like, as well as tending to become opaque during machining operations and, over time, due to their crystalline nature. Accordingly, applicant selected a new amorphous, and therefore permanently transparent, polyamide made by polycondensation from terephthalic acid and an alkylsubstituted hexamethylene diamine (poly hexamethylene terephthalic amide). This polyamide is sold by Dynamit Nobel Aktiengesellschaft, Vertrieb Chemikalien, Abteilung KR D-5210 Troisdorf-Oberlar, Haberstr. 2, Postbox 1209, W-Germany, under the trademark "TROGAMID T". It was selected because of its ease of processing, its high impact, scratch and abrasion resistance, its dimensional stability under the influences of heat and moisture, its low water absorption and electrical properties resisting arcing.

These properties all lend themselves well to the making of an improved high voltage relay as disclosed herein. It was discovered also that coating of the interior of the housing was not necessary to protect the special, selected polyamide because it was inherently resistant to attack by the fluorine.

The various novel features of the invention summarized above result in the production of a compact, efficient, serviceable, durable high voltage relay which is ideally suited for, but not necessarily limited to, use as a control relay in a high voltage heart defribillator.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
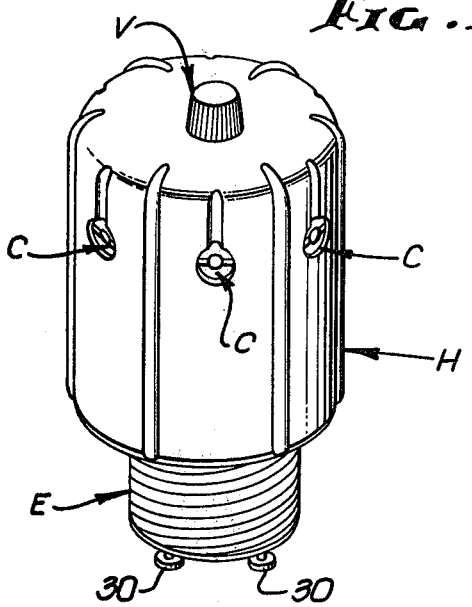
FIG. 1 is a perspective showing a high voltage relay assembly embodying the invention.

As seen in the drawings, the relay comprises a housing H having a support structure including an electromagnet unit E at one end or at its base and a valve structure V at its upper end. Spaced circumferentially of the housing is a plurality of connector means C whereby, in the illustrated form, six conductors can be connected with the assembly to enable selected current flow, under the control of internal switch means S operable by the electromagnet E.

As illustrated herein, the switching mechanism and the operating means therefor are essentially the same as disclosed in the aforementioned U.S. Pat. No. 3,604,870, and the connecter C are arranged in the same circumferentially spaced relationship as in that patent. However, it will be understood that the arrangement of connectors and the switch mechanism and operating means may also be like that shown in the above-mentioned U.S. Pat. No. 4,039,984.

Figure 8:
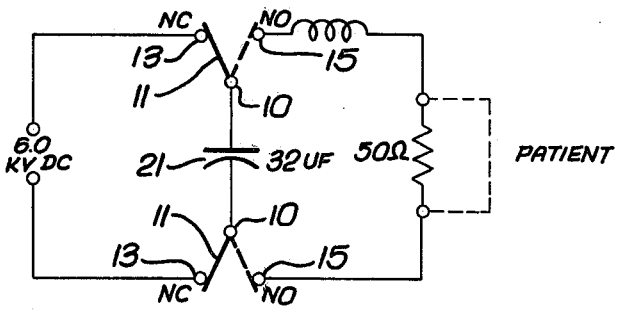
FIG. 8 is a diagram of a circuit connected with the relay for use in a heart defibrillator.

In any event, in the illustrative relay, the circumferentially spaced connectors C provide a pair of diametrically spaced conductor terminals 10, which pivotally support a pair of switch arms 11 having normally closed contact ends 12 adapted to engage a pair of adjacent terminals 13, at one side of the housing, and a pair of normally open contact ends 14 adapted to engage another pair of adjacent terminals 15 at the other side of the housing. The switch arms 11 are adapted to be actuated between the normally closed position of FIG. 2 to the alternate position with the contact ends 14 in engagement with the terminals 15, in response to actuating movement of an arm 16 which engages an insulating rod such as a saphire rod 17, to which lever arms 18 of contacts 18*a* of the respective switch arms 11 are also connected. The actuator 16 is part of an armature plate 19 of the electromagnet E, and a spring 20 normally biases the armature plate 19 in a direction to pivot the switch arms 11 about the pivot terminals 10 to the normally closed position. Energization of the electromagnet will effect pivotal movement of the switch arms 11 to the alternate position. Referring to FIG. 8, a schematic diagram of a circuit for use in a heart defibrillator is illustrated which can be controlled by the switching arrangement of the relay as generally described above. As illustrated, a direct current source is connected to a suitable capacitor 21 when the switch is in the normally closed condition, but when the switch is actuated to the alternate, normally open position, the capacitor will be discharged to a patient to provide a high voltage pulse, as is well known. The shifting of the switch contacts of course without requiring illustration, is under the control of the electromagnet E.

This electromagnet E includes a coil housing 22 having an outer mounting flange 23 and a threaded body section 24 adapted to receive a pair of axially spaced mounting nuts 25 and an intermediate lock washer 26, whereby the housing 22 can be securely clamped upon a support plate 27, shown broken away. Within the coil housing is an electromagnetic coil 28 covered by insulating material 29 and having coil terminals 30 projecting through a soft ion lower end plate 32 of the coil housing, and connectable to a electrical source (not shown). This plate 32 is secured to the core 33 within the magnetic coil by a fastener 33*a* engaged in a threaded bore 33*b* of the core. The core extends upwardly through a separator plate 34, say of Monel, suitably braised or connected to the core and to the body 22. An armature support member 35 is secured to the inner end of the housing, as by braising at 35*a* and carries a pivot pin 36 on which the armature 19 is pivotally supported for actuating between the position shown in FIG. 2, under the influence of the coil spring 20, and to the alternate position upon energization of the coil 28.

The electromagnetic assembly E is secured to the housing H by the connector flange 23 which is mounted upon the exterior of the housing and suitably affixed as by braising at 37. The flange 23, adjacent its outer periphery is connected to the underside of the housing by means of a plurality of circumferentially spaced screw fastenings 38. Means are provided to provide a pressure tight seal between the flange and the housing H. In the preferred form, the sealing means is provided by an elastomeric, annular sealing ring 39 disposed within a triangular space defined between a circumferentially extended flange 40 on the mounting flange 23 and a downwardly and outwardly inclined or beveled lower wall 41, provided within the housing H. Thus the seal ring 39 is deformed between the opposed beveled wall 41 and flange 40 to provide an effective seal when the housing is pressurized with a dielectric gas.

Figure 3:
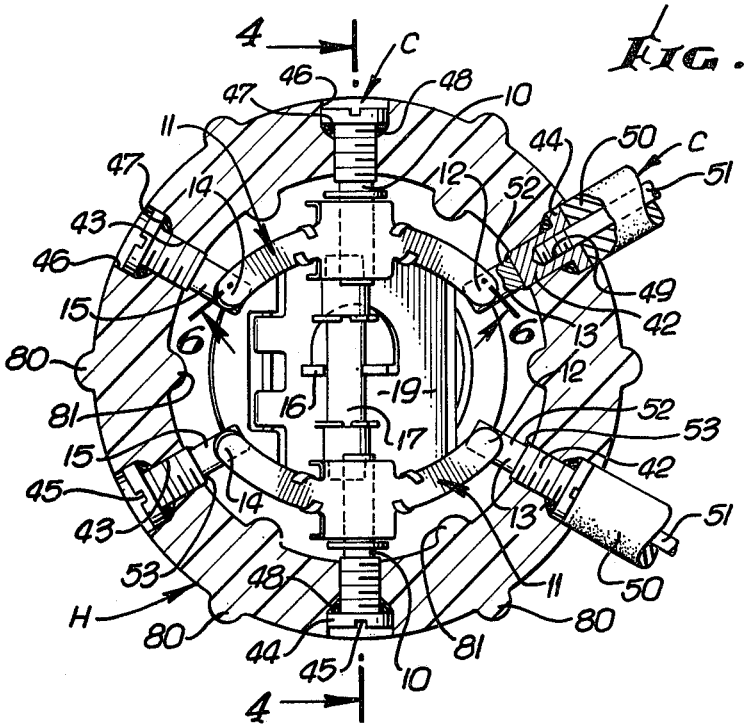
FIG. 3 is a transverse section, as taken on the line 3—3 of FIG. 2.

The connectors C are also sealed in the housing H in order to prevent the leakage of the dielectric gas therefrom. As seen in FIG. 3, for example, each connector C comprises a threaded stem section 42 engaged in an internally threaded radial bore 43 in the housing. At its outer end, the stem 42 has an enlarged head 44 provided with a suitable screw slot 45, whereby the stem can be threaded into the bore 43. The head 44 is disposed in an enlarged counter-bore 46, at the base of which is an inclined sealing surface 47, opposed by the transverse inner surface of the connector head 44. Thus, there is defined a triangular space extending circumferentially of the connector and in which is disposed a resilient, elastomeric sealing ring 48 which is loaded against the inclined surface 47 by the connector head 44 to effect a pressure tight seal. In addition, the connector stem 42 is provided with a threaded bore 49 which opens outwardly and receives the electrical conductor to make an effective electrical contact therewith. As shown, the insulating material 50 which is disposed about the conductor 51 extends somewhat into and fits within the enlarged bore 46 of the housing. At the inner end of each connector stem 42 of the contact terminals 13 and 15 is a cylindrical contact section 52 which may be composed of tungsten and braised at 53 to the inner end of the connector stem. Each of the connectors for the terminals 10 also has a tungsten contact member 54 connected thereto, as by braising at 55, and providing an elongated pivot point for the respective switch arms 11, as will be later described.

Figure 2:
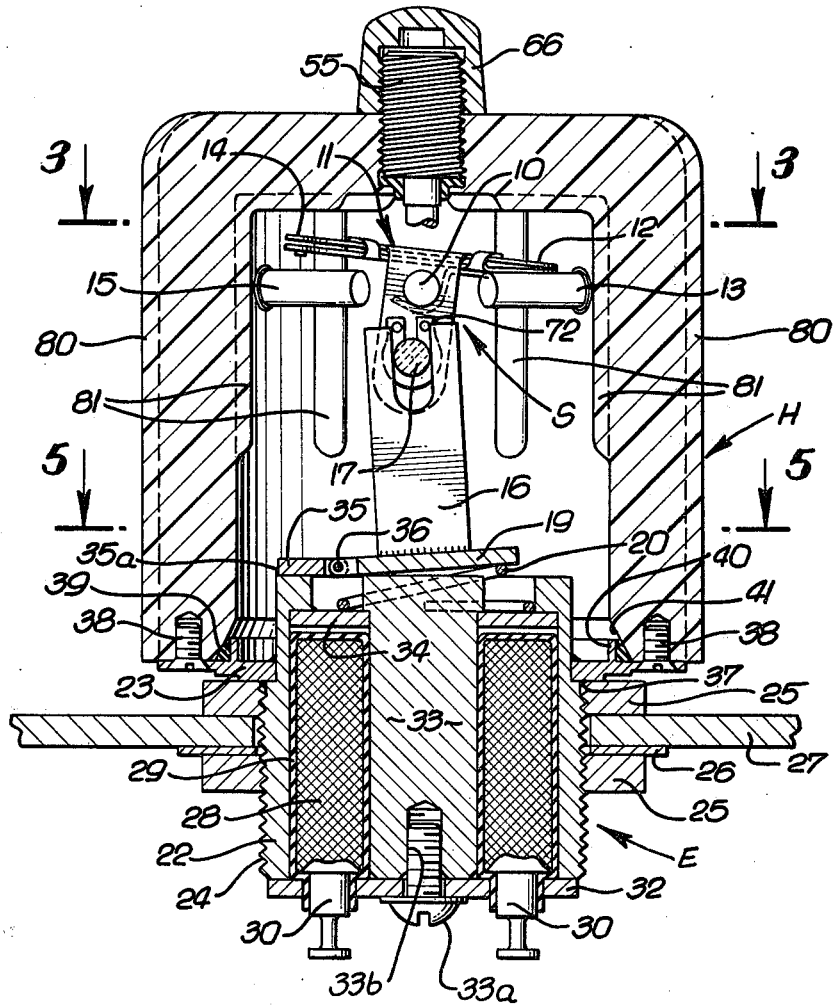
FIG. 2 is a longitudinal section, on an enlarged scale.
Figure 4:
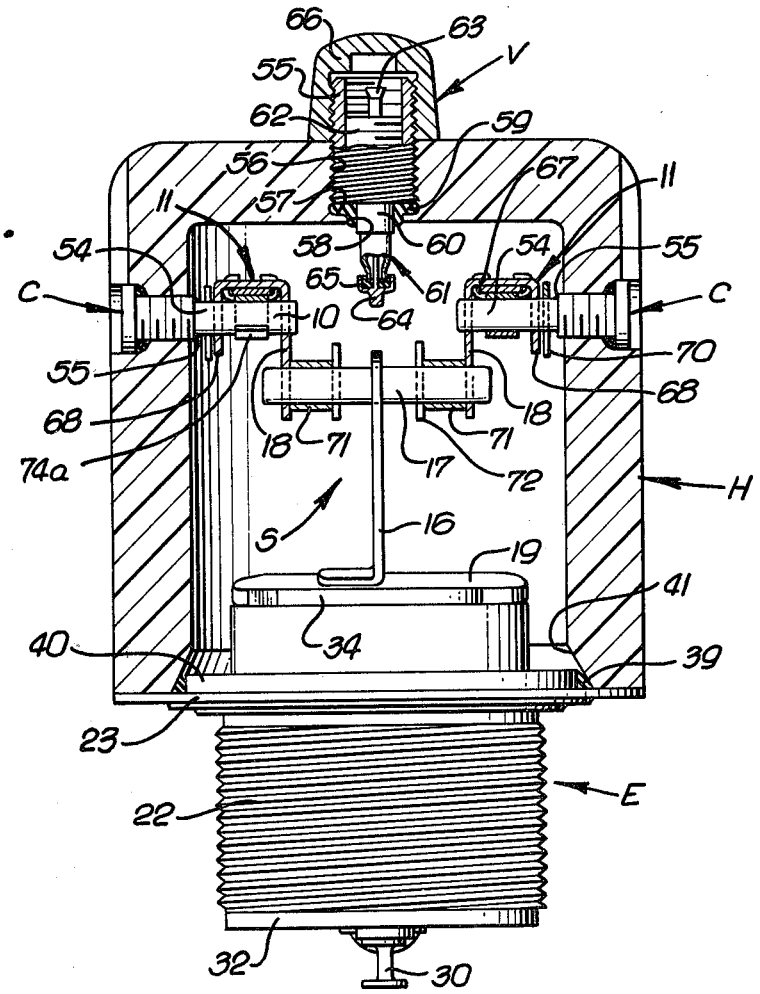
FIG. 4 is a longitudinal section, as taken on the line 4—4 of FIG. 3.
Figure 5:
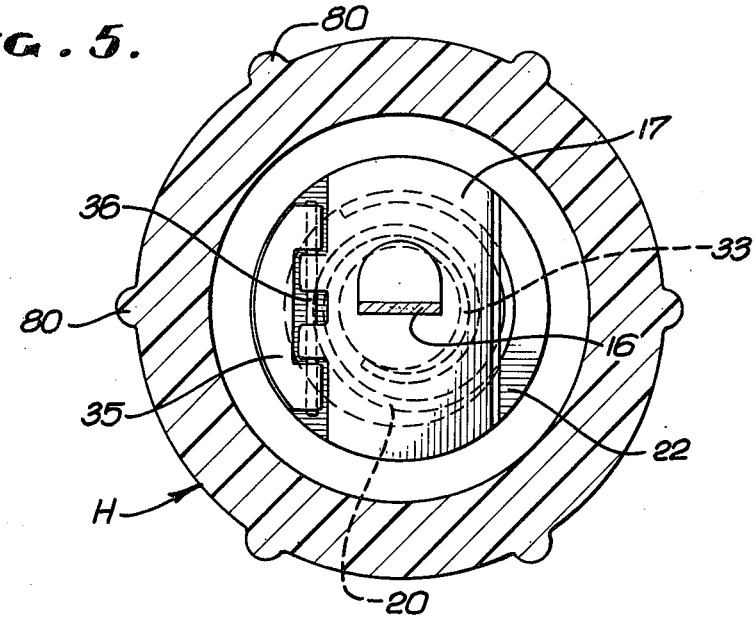
FIG. 5 is a transverse section, as taken on the line 5—5 of FIG. 2.

As previously indicated, the valve means V is adapted to permit the housing H to be filled with a dielectric gas. Referring to FIGS. 2 and 4, it will be seen that the valve means lead includes an outer ferrule or sleeve 55 threaded into an internal bore 56 in the top of the housing H. At the base of the bore 56 is an outwardly facing shoulder 57 and a reduced diameter opening 58 providing a seat for an elastomeric sealing ring 59 which is resiliently pressed against the shoulder 57 and extends into the reduced bore 58 to provide a resilient sealing means at the lower end of the ferrule 55 adapted to receive and be sealingly engaged with the body 60 of a valve unit 61. This valve unit has a threaded section 62 threadedly engaged within the internal threaded bore of the sleeve 55 and includes the usual outwardly extended stem 63 which extends through the valve body and engages a head 64 having a resilient seal 65 engageable with the lower end of the body for effecting a seal against the escape of pressure from within the housing. Preferably, a threaded cap 66 is engaged with the external threads on the sleeve or ferrule 55 and is threaded down into tight seating engagement with the relay housing.

Figure 7:
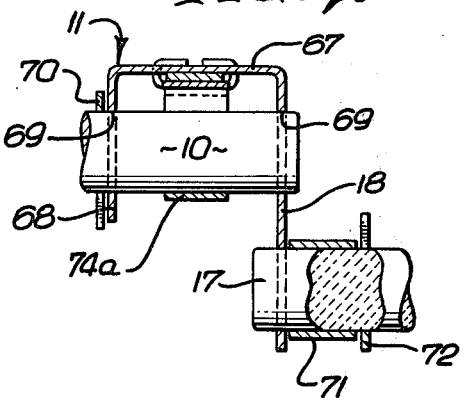
FIG. 7 is a fragmentary detail view in section, as taken on the line 7—7 of FIG. 6.

The switch arms 11, as previously indicated, are pivotally mounted on the terminal members 10 and have their operating arms 18 engaged with the insulating or saphire rod 17. As seen in FIGS. 4 and 7, to best advantage, the (operating) contact members 18*a* for the switch arms have a bridge section 67 extending parallel to the terminal support 10 and an end section 68 bent back into parallel relation to the operating arm portion 18, the portions 18 and 68 having openings 69 whereby the contact arms are supported upon the terminal supports 10, which extend through the openings 69. A split, resilient lock ring 70 is applied to the terminal support 10 on the outside of the wall 68, and at the opposite side of the operating arm 18, on the saphire or insulator rod 17, is a spacer 71, disposed about the rod 17 and another resilient, split lock ring 72, whereby the switch arms 11 are essentially held against substantial longitudinal displacement with respect to the terminal supports 10 and the insulating rod 17 is likewise held against displacement from the operating arms 18 of the switch contacts 18*a*.

Figure 6:
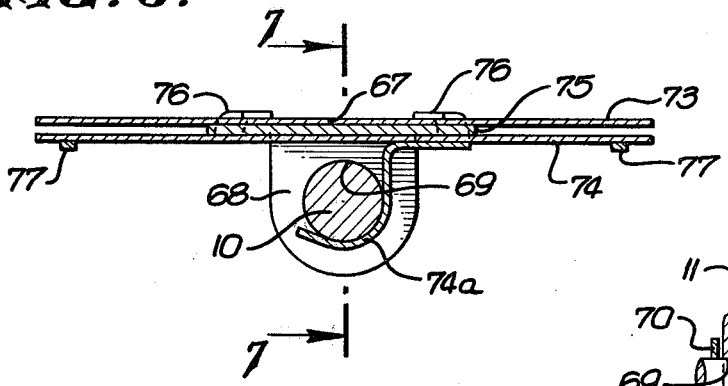
FIG. 6 is a fragmentary detail view in section, as taken on the line 6—6 of FIG. 3.

The switch arms 11 are composite structures, including arcuately extended upper arm sections 73 formed integral with the bridge section 67 of the contact members and supporting therebeneath arcuately extended lower, resilient contact members 74. These contact members 74 are spaced from the upper contact member 73 by an intermediate spacer 75, the assembly being maintained by tab sections 76 formed on the lower, resilient contact arms 74 and turned into overlying relation to the upper contact members 73, at opposite sides of the bridge section 67. At the ends of the resilient contact elements 74 are tungsten contact points 77 adapted for alternate coengagement with the respective terminal members 13 and 15, upon operation of the relay from the normally closed condition to the alternate position for discharging the capacitor of FIG. 8 to the load. The contact points 77 concentrate the current flow between the points and the terminal members 13 and 15 so as to breakdown contact resistance caused by the accumulation of sulfur from the sulfur hexachloride at the contact faces. The resilience of the contact member 74 prevents rebound effects from breaking contact once contact is made. A spring contact arm 74*a* (FIGS. 6 and 7) is made a part of or attached to the contact member 74 and extends arcuately about the respective contact members 54 for sliding electrical contact therewith during pivotal movement of the switch arms 11.

As previously indicated, the switch elements per se are not germane to the present invention, but are more particularly those also disclosed in the above-identified U.S. Pat. Nos. 3,604,870 or 4,039,984. However, when the housing H is pressurized to a number of atmospheres with the dielectric sulfur hexachloride, operation of the switch results in the production of fluorine within the housing. Since it is desirable that the housing be transparent, both for assembly, disassembly and repair, as well as during normal use, and since the housing should be resistant to breakage and change of form due to the presence of heat, the housing is composed of a polyamide material which can be readily molded or which can be machined and then polished to provide good transparency. The usual polyamides, being crystalline, do not remain transparent for substantial periods of time, and in any event, are subject to attack by the fluorine produced within the housing, during use of the relay, unless the housing is coated with a clear resistant material. According to the present invention however, a polyamide material has been selected for the purposes of production of the housing which has the desirable physical characteristics of high impact resistance, resistance to heat, good insulating characteristics, and transparency, but which also remains transparent over a long period of time, notwithstanding the presence of fluorine within the housing.

The selected polyamide is an amorphous, transparent polyamide made by polycondensation from terephthalic acid and an alkylsubstituted hexamethylene diamine (polyhexamethylene terethylicamide), such as the "TROGAMID T" referred to above. Because of the stability of such a polyamide under conditions of heat and moisture and the ability of the material to resist moisture absorption, not only are the electrical insulative properties of the relay preserved, but also, the various seals between the removable components and the housing are maintained, notwithstanding substantial internal pressure and heat. This results in ease of manufacture, assembly and repair not heretofore obtainable in the production of relays for heart defibrillator applications of the types disclosed in the above-identified prior patents.

As best seen in FIG. 3 for example, the housing H is also provided with a number of circumferentially spaced and longitudinally extended externally projecting ribs 80 and internally projecting ribs 81 which are centrally located between the respective support terminals 10 and contact terminals 13 and 15. While these ribs afford a certain amount of reinforcement to the housing structure, the primary function of such ribs is to produce a long arc path between the respective terminals, both internally and externally, whereby arcing is inhibited. Preferably, the external ribs 80 extend to the extreme lower end of the housing to also provide additional housing body material in the region of the fastenings 38, as seen in FIG. 2, whereby the magnet assembly is secured to the base of the housing.

From the foregoing it will now be apparent that the present invention provides a novel high temperature relay, particularly adapted for use, though not limited to such use, in high voltage heart defibrillators wherein a durable transparent housing is composed of material which has good characteristics in terms of strength, impact resistance and resistance to change in the presence of heat, but wherein the transparency is maintained for a substantial period of time. In addition the assembly, being easily disassembled can be serviced with ease, and the overall structure and assembly is simpler and less time consuming than those of the above-identified prior patents.

I claim:

1. In a relay comprising a housing of electrical insulating synthetic resin material, terminals in said housing extending through the housing to the exterior thereof, at least one of said terminals providing a contact within said housing, a contact arm within said housing connected to another of said terminals, electromagnetic operating means for engaging said contact arm with said terminal contact and for disengaging said contact arm from said terminal contact, means securing each terminal to said housing and to provide a leakproof seal between said terminals and housing, and means for admitting a gas into said housing: the improvement wherein said synthetic resin is poly hexamethylene terephthalic amide.

2. A relay as defined in claim 1; the further improvement wherein said terminals are removably mounted on said housing and including resilient seal means between said housing and said terminals.

3. A relay as defined in claim 1; the further improvement wherein said terminals include threaded connectors for electrical conductors threaded into said housing, said housing and said connectors having opposed shoulders, and a resilient seal ring between said shoulders.

4. A relay as defined in claim 1; the further improvement wherein said terminals are removably mounted on said housing and including resilient seal means between said housing and said terminals, means removably mounting said electromagnetic operating means on said housing, and including resilient sealing means between said housing and said electromagnetic operating means.

5. A relay as defined in claim 1; further including the improvement wherein said means for admitting gas into said housing comprises valve means, means removably mounting said valve means in said housing including resilient sealing means for said mounting means and said valve means.

6. A relay as defined in claim 1; further including the improvement wherein each of said terminals, said electromagnetic operating means and said means for admitting gas into said housing include means removably securing the same to said housing including an elastomeric seal.

7. In a relay comprising a housing of electrical insulating synthetic resin material, terminals in said housing extending through the housing to the exterior thereof, at least one of said terminals providing a contact within said housing, a contact arm within said housing connected to another of said terminals, electromagnetic operating means for engaging said contact arm with said terminal contact and for disengaging said contact arm from said terminal contact, means securing each terminal to said housing and to provide a leakproof seal between said terminals and housing, and means for admitting a gas into said housing: the improvement wherein said synthetic resin is amorphous, transparent polyamide made by polycondensation from terephthalic acid and an alkyl-substituted hexamethylene diamine.

8. A relay comprising: a housing of electrical insulating material; terminals in said housing providing contact means; contact arm means within said housing connected with another of said terminals; electromagnetic operating means for engaging said contact arm with and disengaging said contact arm means from said contact means; means for admitting gas and retaining said gas under pressure in said housing; said terminals each including a screw in a threaded bore in said housing; a resilient seal ring between said screw and said housing to prevent loss of gas from said housing; each screw having means for connection with an electrical conductor.

9. A relay as defined in claim 8; said screw having an enlarged head thereon; said housing having a shoulder extending about said bore; said seal ring being between said head and said shoulder.

10. A relay as defined in claim 8; said screw having an enlarged head thereon; said housing having a bevelled shoulder extending about said bore; said seal ring being between said head and said shoulder.

11. A relay as defined in claim 8; said means for connection with an electrical conductor being a threaded bore in said screw.

12. A relay as defined in claim 8; said contact means being a rod united with said screw in said housing.

13. A relay as defined in claim 8; said means for admitting gas and retaining gas in said housing including valve means having a support threaded into said housing and resilient seal means between said housing and said support.

14. A relay as defined in claim 8; said means for admitting gas and retaining gas in said housing including valve means having a support threaded into said housing and resilient seal means between said housing and said support, said valve means including a body extending through said seal means and sealingly engaged thereby.

15. A relay as defined in claim 8; means removably securing said electromagnetic operating means to said housing including a resilient seal means preventing loss of gas from said housing.

16. A relay as defined in claim 8; said housing having formations between said terminals projecting from the housing and forming an elongated arc path.

17. A relay as defined in claim 8; said housing having formations between said terminals projecting from the housing and forming an elongated arc path; said formations being internally of said housing and externally of said housing.

18. In a relay comprising a housing of electrical insulating synthetic resin material, terminals in said housing extending through the housing to the exterior thereof, at least one of said terminals providing a contact within said housing, a contact arm within said housing connected to another of said terminals, electromagnetic operating means for engaging said contact arm with said terminal contact and for disengaging said contact arm from said terminal contact, means securing each terminal to said housing and to provide a leakproof seal between said terminals and housing, and means for admitting a gas into said housing; said housing having formations between said terminals projecting from the housing and forming an elongated arc path.

19. In a relay comprising a housing of electrical insulating synthetic resin material, terminals in said housing extending through the housing to the exterior thereof, at least one of said terminals providing a contact within said housing, a contact arm within said housing connected to another of said terminals, electromagnetic operating means for engaging said contact arm with said terminal contact and for disengaging said contact arm from said terminal contact, means securing each terminal to said housing and to provide a leakproof seal between said terminals and housing, and means for admitting a gas into said housing: the improvement wherein said synthetic resin is amorphous, transparent polyamide made by polycondensation from terephthalic acid and an alkyl-substituted hexamethylene diamine.

* * * * *